United States Patent [19]

Baumann et al.

[11] 3,994,674

[45] Nov. 30, 1976

[54] DETACHABLE BURNER ASSEMBLY FOR GAS-BURNING TORCH

[75] Inventors: Richard S. Baumann, Glenbeulah; Ronald K. Raboin, Green Bay, both of Wis.

[73] Assignee: Western Industries, Inc., Milwaukee, Wis.

[22] Filed: Mar. 14, 1975

[21] Appl. No.: 558,215

[52] U.S. Cl. ..... 431/354; 431/344; 239/587; 239/600; 285/345

[51] Int. Cl.[2] ..... F23D 13/40

[58] Field of Search ..... 431/344, 354, 355; 239/600, 587; 285/321, 345; 251/149.7

[56] References Cited

UNITED STATES PATENTS

| | | | |
|---|---|---|---|
| 1,538,007 | 5/1925 | Schellin | 285/345 |
| 2,145,189 | 1/1939 | Nathan et al. | 285/232 |
| 2,280,728 | 4/1942 | Streib | 285/345 |
| 2,410,215 | 10/1946 | Houghton | 239/587 |
| 2,518,895 | 8/1950 | Jacobsson et al. | 285/345 |
| 2,829,909 | 4/1958 | Magnani | 285/345 |
| 3,081,877 | 3/1963 | Jakobs et al. | 239/587 |
| 3,434,745 | 3/1969 | Jackman | 285/321 |
| 3,612,037 | 10/1971 | Spiggle | 126/414 |
| 3,736,093 | 5/1973 | Bowman et al. | 431/344 |
| 3,773,360 | 11/1973 | Timbers | 285/321 |

FOREIGN PATENTS OR APPLICATIONS

| | | | |
|---|---|---|---|
| 130,196 | 12/1948 | Australia | 285/345 |
| 21,436 | 8/1916 | Denmark | 285/345 |
| 760,441 | 10/1956 | United Kingdom | 239/587 |

*Primary Examiner*—Carroll B. Dority, Jr.
*Attorney, Agent, or Firm*—James E. Nilles

[57] ABSTRACT

A torch for use with a portable tank of pressurized liquified combustible gas, such as MAPP type gas, comprises a regulator valve assembly, including a valve body having a gas outlet therein, and a burner assembly, including a combined burner tube, venturi member and orifice member, which is releasably and adjustably connected in sealed relationship to the outlet on the valve body by frictional retaining means so as to enable quick and easy pull-out and push-in substitution of different-sized burner assemblies, while still allowing for rotational adjustment or positioning of an installed burner assembly.

12 Claims, 6 Drawing Figures

DETACHABLE BURNER ASSEMBLY FOR GAS-BURNING TORCH

BACKGROUND OF THE INVENTION

1. Field of Use

This invention relates generally to gas burning torches used with portable containers of pressurized liquified combustible gas. In particular, it relates to such torches which comprise a regulator valve assembly and a detachable burner assembly.

2. Description of the Prior Art

U.S. Pat. No. 3,736,093 discloses a gas burning torch of the aforesaid character wherein the burner assembly, which comprises an offset burner tube and an integrally formed venturi member and orifice member, has an externally threaded lower end portion which screws into an internally threaded gas outlet opening in the valve body. In this manner, the burner is mechanically supported and connected to the gas supply. During manufacture, or in the case where replacement of the burner assembly is required, the lower end of the burner assembly is screwed into place on the valve housing and assumes a final fixed or stationary position wherein it cooperates with an O-ring gas seal. However, it is clumsy and time-consuming to screw a burner assembly in or out of position whenever a substitution needs to be made, particularly one having a bent or offset burner tube. Furthermore, in prior art torches having burner assemblies of the screw-in type, the full screwed-in position is always the same and the offset burner tube cannot be rotationally moved or adjusted to position the burner tip in the optimum position for the work at hand unless a lock nut on the threaded connection is first adjusted to permit this. In torches where a gas such as MAPP gas is used and it is frequently necessary to substitute burner assemblies of different sizes to obtain the most efficient use of the wider range of capabilities of the gas the problem of frequently changing screw-in type burner assemblies is troublesome.

SUMMARY OF THE PRESENT INVENTION

In accordance with the invention a torch for use with a portable tank of pressurized liquified combustible gas, such as MAPP type gas, comprises a regulator valve assembly, including a valve body having a gas outlet therein, and a burner assembly, including a combined burner tube, venturi member and orifice member, which is releasably and adjustably connected in sealed relationship to the outlet on the valve body by frictional retaining means so as to enable quick and easy pull-out and push-in substitution of different-sized burner assemblies, while still allowing for rotational adjustment or positioning of an installed burner assembly.

In a preferred embodiment of the invention the valve body has a gas outlet in the form of a hole formed in said valve body and a gas passage is provided in the valve body in communication with said gas outlet. Valve means are provided in the valve body for controlling gas flow from the gas passage to the gas outlet. The burner assembly is connected to the valve body and has passage means therein in communication with the gas outlet. The burner assembly comprises a burner tube having a tip end and a lower end, a venturi member connected to the lower end of the burner tube and an orifice member connected to the venturi member.

The orifice member extends into the hole in the valve body. Resilient retaining means are disposed between and frictionally engage the orifice member and the side wall of the hole in the valve body for releasably securing said burner assembly to the valve body. Sealing means are disposed between and engage the orifice member and the side wall of the hole in the valve body to prevent gas from the gas outlet from flowing other than into the burner assembly.

Preferably, the gas outlet comprises a cylindrical hole or bore formed in the valve body, the burner assembly comprises a cylindrical orifice member which extends into the cylindrical hole, and the resilient retaining means comprises an annular member which surrounds the cylindrical orifice member of the burner assembly. The annular member is a split ring which is provided with corrugations around the periphery thereof between the opposite ends thereof, and at least one of said ends has an inwardly tapered portion adjacent thereto to facilitate axial insertion of the annular member into the cylindrical hole of the gas outlet. Preferably, the sealing means comprises a resilient annular member which surrounds the cylindrical orifice member of the burner assembly.

The frictional retaining ring provides an axial and radial holding force between the orifice member of the burner assembly and the sides of the gas outlet bore in the valve body. Radial movement of the burner assembly is impaired only to the extent necessary to retain the tip of the burner in a radial position in which it is placed. Axial movement of the burner assembly is impaired to the extent necessary to overcome the force exerted by regulated gas pressure upstream from the orifice member. The burner assembly is easily removed from or inserted into the outlet in the valve body by overcoming these design forces.

The burner assembly design and means for attachment to the valve body provide a simple means of insertion and removal of various sizes of burner assemblies without the use of screw threads and lock nuts. Since the orifice member and venturi members are integral with the burner assembly, no tools or additional seals are required. In addition, the burner assembly can be inserted in any radial position relative to the valve body and still maintain the gas seal without the use of screw threads and lock nut.

Other objects and advantages of the invention will hereinafter appear.

DRAWINGS

DESCRIPTION OF PREFERRED EMBODIMENTS

Figure 1:
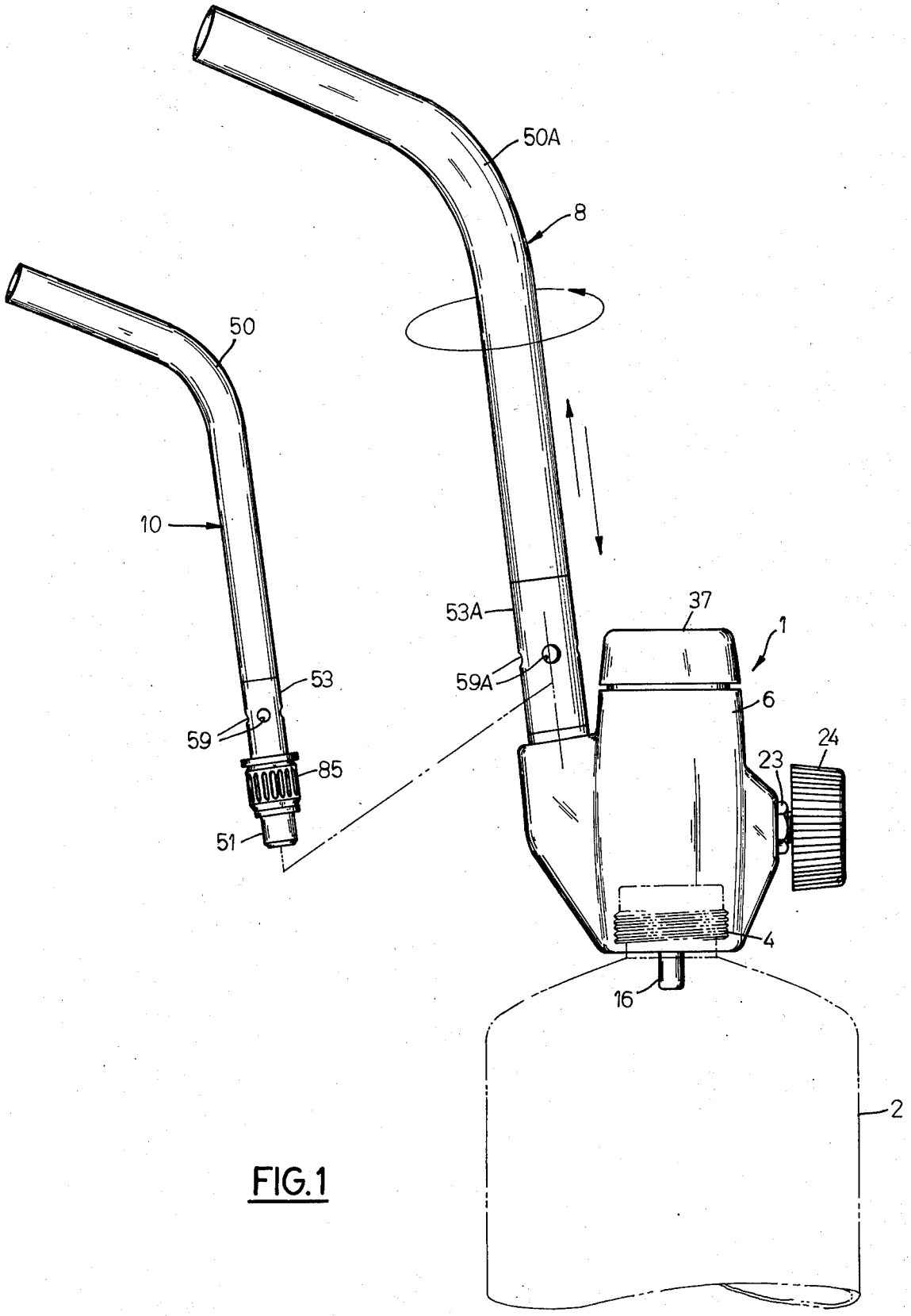
FIG. 1 is a side elevational view of a regulator torch in accordance with the invention and shows two detachable burner assemblies of different sizes therefor, one burner assembly being shown attached and the other being shown detached.

Referring to FIG. 1, the numeral 1 designates a torch in accordance with the invention shown attached to a tank or container 2 of a supply of pressurized fuel, such as MAPP gas, in the liquid state. Tank 2 is of conventional construction and comprises a threaded connector portion or neck 4 which has a conventional outlet valve (not shown) therewithin.

Figures 2, 3, 4, 5, 6:
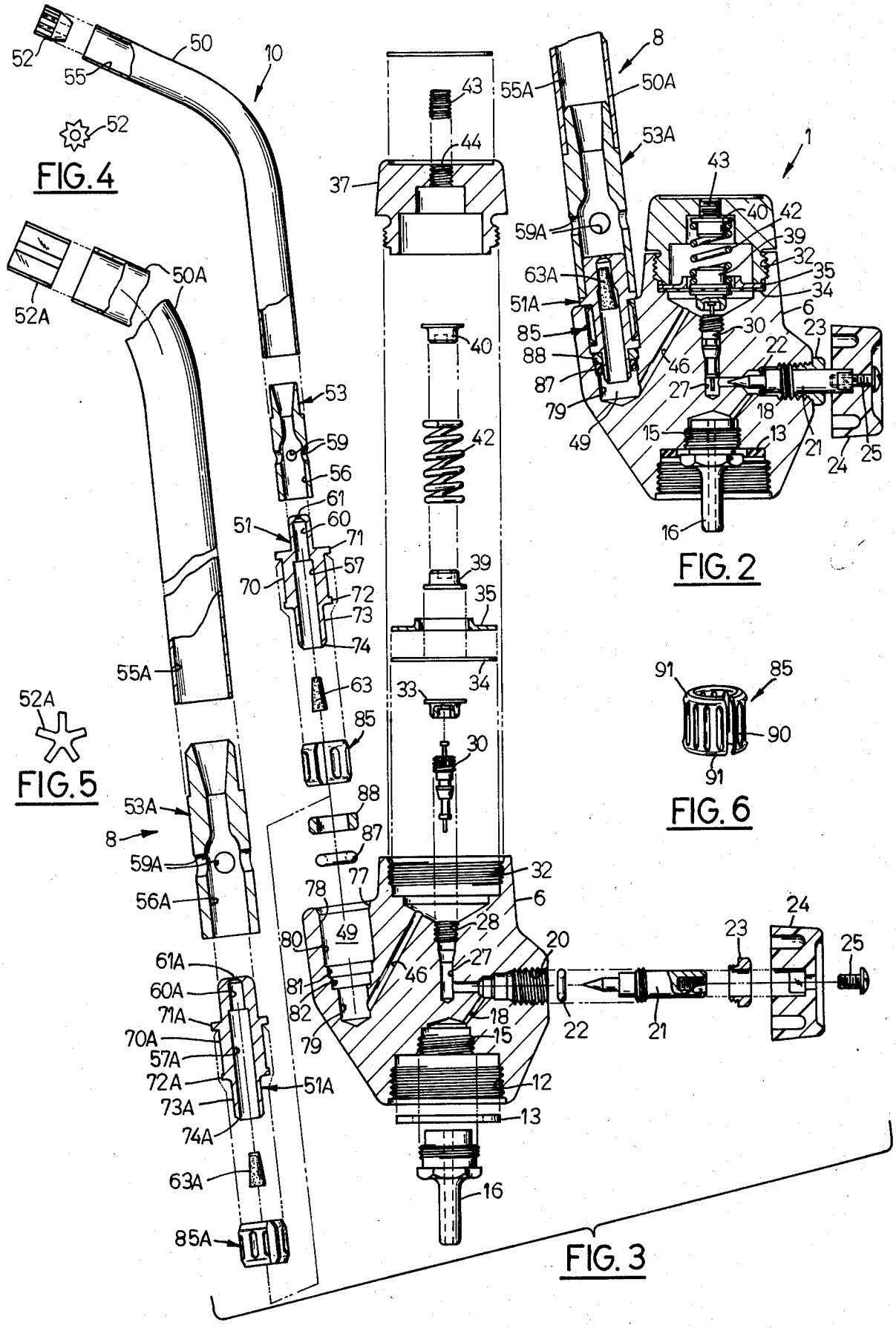
FIG. 2 is a cross-sectional view of the regulator valve and a portion of the attached burner assembly of the torch shown in FIG. 1.
FIG. 3 is a cross-sectional exploded view of the regulator valve and the two burner assemblies shown in FIG. 1.
FIG. 4 is an end view of a flame shaper for use in the attached burner assembly shown in FIG. 3.
FIG. 5 is an end view of a flame shaper for use in the detached burner assembly shown in FIG. 3.
FIG. 6 is an enlarged perspective view of the retainer ring used with the burner assemblies shown in FIGS. 1 and 3.

Torch 1 comprises a valve body 6 in which a needle valve assembly and a pressure regulator valve assembly hereinafter described, are disposed and to which a first or larger burner assembly 8 is connected. As FIGS. 1 and 3 show, a second or small burner assembly 10 may be substituted for, or used interchangeably with, burner assembly 8. Except for the size of certain components, the burner assemblies 8 and 10 are identical.

As FIGS. 2 and 3 show, valve body 6 comprises an internally threaded opening 12, having a gasket 13 therein, which is adapted to make threaded engagement with externally threaded neck 4 of tank 2 and thereby support the torch 1 on the tank. A smaller internally threaded opening 15 in opening 12 is adapted to make threaded engagement with an externally threaded hollow core member 16 which is adapted to pierce the outlet valve (not shown) on tank 2 when the torch is screwed onto the tank and thereby to the gas supply therein.

Opening 15 communicates by a small passage 18 with an internally threaded needle valve passage 20 in which an externally threaded needle valve 21 is adjustably (rotatably) mounted. Needle valve passage 20 accommodates a sealing O-ring 22 and also an externally threaded needle valve retaining nut 23. A needle valve adjustment knob 24 is rigidly secured to the external end of the needle valve 21 by a screw 25. Knob 24 is used to adjust the position of needle valve 21 and thereby start, stop and control the flow of gas from tank 2 to the torch 1.

Needle valve passage 20 communicates with a pressure regulator valve passage 27 which has a narrow threaded portion 28 in which an externally threaded regulator valve 30 is threadedly engaged. Valve 30 is, for example, the same type of valve as is used in an automotive tire. Regulator valve passage 27 also has a wide threaded portion 32 in which a valve actuator disc 33, a diaphragm 34 and a washer 35 are entrapped by an externally threaded nut or cap 37 which makes threaded engagement with the threaded portion 32 of passage 27. The central hole in washer 35 accommodates a lower disc or spring cap 39 and a central hole in nut 37 accommodates an upper disc or spring cap 40 and a coiled compression spring 42 is entrapped between the spring caps 39 and 40. A spring-tension adjustment screw 43 extends through a threaded hole in nut 37 and bears against the upper spring cap 40 to enable adjustment to be made in the amount of force exerted by spring 42 on diaphragm 34 (and, thus, on valve 30).

Regulator valve passage 27 communicates by means of a passage 46 with a gas outlet or hole 49 which extends inwardly of valve body 6 from the exterior surface thereof and to which the burner assembly 6 or 8 is connected, as hereinafter described.

The pressure regulator valve assembly automatically increases and decreases fuel flow from tank 2 in response to a decrease and increase, respectively, in the internal tank pressure caused by the ambient operating temperature. The torch 1 provides a greater rate of fuel flow from tank 2 at low temperatures and conversely provides a lesser rate of fuel flow from the tank at higher temperatures. Furthermore, regulator valve 30 produces a first pressure drop in fuel passing from fuel tank 2 into the regulator which causes partial vaporization of the liquid state of the fuel should the torch 1 be inverted during use, and a second pressure drop as the partially vaporized fuel passes through the torch orifice. The sequential pressure drops result in complete vaporization of the fuel when the torch is held in the inverted position at ambient temperatures as low as 0° F. Heat imparted to the partially vaporized fuel by the regulator during its dwelling time therein also aids in vaporizing the liquid-gaseous fuel mixture within the regulator when the torch is inverted.

As FIGS. 1 and 3 show, burner assembly 10 comprises a burner tube 50, preferably bent or offset to facilitate positioning of the burner tip and flame during use, and a hollow fluted flame shaper member 52 (shown in FIGS. 3 and 4) is rigidly mounted within the upper end of tube 50. Burner assembly 10 further comprises a venturi member 53 which is rigidly secured at its upper end as by welding to the lower end of tube 50 and an orifice member 51 is rigidly secured at its upper end as by welding to the lower end of venturi member 53. Tube 50 has a central passage 55 which communicates with a central passage 56 in venturi member 53 and the latter passage communicates with a central passage 57 in orifice member 51. Air intake holes 59 extend through the side wall of venturi member 53 and communicate with the central passage 56 thereof. Central passage 57 in orifice member 51 narrows as at 60 and terminates in a small orifice 61 which is sized to suit the size and proportions of the venturi passage 56, the air intake holes 59 and the diameter of tube passage 55. A conically shaped porous sintered metal filter 63 is press-fitted in narrow portion 60 of passage 57 of orifice member 51.

Burner assembly 8 is similar in construction to burner assembly 10 and comprises a burner tube 50A, a flame shaper member 52A, a venturi member 53A, an orifice member 51A, and a filter 63A, all arranged and connected in the same order and manner as similar components in burner assembly 10.

As FIG. 2 shows, the burner assembly 10 comprises burner tube 50 having a tip end and a lower end, venturi member 53 connected to the lower end of the burner tube and orifice member 51 connected to the venturi member. Orifice member 51 has a cylindrical intermediate portion 70 disposed between an upper cylindrical flange 71 and a lower cylindrical flange 72 and also has a narrower cylindrical projecting lower portion 73 which terminates in a chamfered or bevelled lower edge 74. The orifice member 51 extends into generally cylindrical hole 49 in valve body 6, which hole has a bevelled upper edge 77, a cylindrical upper section 78, a narrower cylindrical lower section 79, and three shoulders 80, 81 and 82 disposed therebetween. Resilient retaining means in the form of a split ring 85 is disposed around portion 70 of orifice member 51 between and frictionally engaging the orifice member 51 and the side wall of section 78 of hole 49 in valve body 6 for releasably securing burner assembly 10 to the valve body 6. Sealing means in the form of a resilient annular O-ring 87 is disposed around portion 73 of orifice member 51 between and engaging the orifice member 51 and the side wall of section 79 of hole 49 in valve body 6 to prevent gas entering the gas outlet 49 from passage 46 from flowing other than into passage 51 in orifice member 56 and from there through burner assembly 10. The O-ring 87 rests on shoulder 82 in outlet 49 and is held in position by a bushing 88 disposed thereabove and resting on shoulder 81 in outlet 49. Lower flange 72 of orifice member 51 rests on shoulder 80 in outlet 49.

The resilient retaining means or split ring 85, shown separately in FIG. 6, is an annular member which surrounds the cylindrical portion 73 of orifice member 51. The split ring 85 which is formed of stamped sheet metal is provided with corrugations 90 around the periphery thereof between the opposite ends thereof, and at least the lower one of said ends has an inwardly tapered portion 91 adjacent thereto to facilitate axial insertion of the split ring into the cylindrical portion 78 of gas outlet 49.

The split ring 85 is a corrugated, open ring of hardened steel, with tapered rims at the ends of the corrugations and serves as a wedging shim between the two cylindrical portions 70 and 78.

Due to its elasticity the ring 85 allows wider tolerances and maintains its grip under varying conditions of temperature, load and alignment. Ring 85 provides low cost assembly by eliminating threads as in prior art burner assemblies. Furthermore, it allows for self-alignment and divergent rates of expansion of related parts without losing its grip on them. It is inexpensive, effective and fool proof.

The frictional retaining ring 85 provides an axial and radial holding force between the orifice member 51 of burner assembly 10 and the sides of section 78 of outlet 49 in valve body 6. Radial movement of the burner assembly 10 is impaired only to the extent necessary to retain the tip of the burner in a radial position in which it is placed. Axial movement of the burner assembly 10 is impaired to the extent necessary to overcome the force exerted by regulated gas pressure upstream from the orifice member 51. The burner assembly 10 is easily removed from or inserted into outlet 49 in valve body 6 by overcoming these design forces.

The design of the burner assemblies 8 and 10 and the means for attachment to the valve body 6 provide a simple means of insertion and removal of various sizes of burner assemblies without the use of screw threads and lock nuts. Since the orifice member 51 and venturi member 53 are integral with the burner assembly 10 no tools or additional seals are required. In addition, the burner assemblies 8 and 10 can be inserted in any radial position relative to the valve body 6 and still maintain the gas seal without the use of screw threads and lock nuts.

In an actual embodiment of burner assembly 10 for example, the following dimensions and tolerances were employed as regards outlet 49, orifice member 51 and retaining ring 85. Cylindrical upper section 78 of outlet 49 had an inside diameter of 0.433 to 0.434 inches. Portion 73 of orifice member 73 had an outside diameter of 0.247 to 0.249 inches and a length of about 0.420 inches, including the thickness of lower flange 72.

The forces exerted by the corrugations 90 of the split retaining ring 85 are a result primarily of a radial containment by the wall of portion 78 of gas outlet 49 which has a diameter of lesser dimension than the maximum diameter of the corrugations of the ring as installed on portion 73. The resilient nature of the ring material allows the ring 85 to conform to the lesser dimension of the hole portion 78 thereby exerting a constant force outward and inward in a magnitude that is proportional to the amount of interference. Particularly, the diameters of the critical components of the burner assemblies 10 and 8 in accordance with the force values required for detaching or attaching the assemblies are sized to provide an interference of 0.003 to 0.005 between the maximum ring dimension as installed on the orifice member diameter to and the valve body diameter 49.

We claim:

1. In a torch for use with a container of pressurized combustible gas: a valve body having a gas outlet in the form of a hole formed in said valve body and a gas passage in said valve body in communication with said gas outlet; valve means in said valve body for controlling gas flow from said gas passage to said gas outlet; a burner assembly connected to said valve body and having passage means therein in communication with said gas outlet, said burner assembly comprising a burner tube having a tip end and a lower end, a venturi member connected to said lower end of said burner tube and an orifice member connected to said venturi member, said orifice member extending into said hole in said valve body; resilient retaining means disposed between and frictionally engaging said orifice member and the side wall of said hole in said valve body, said resilient retaining means providing an axial and radial holding force for releasably securing said burner assembly to said valve body and for maintaining said burner assembly in a radial position in which it is placed; and sealing means disposed between and engaging said orifice member and the side wall of said hole in said valve body to prevent gas from said gas outlet from flowing other than into said passage means in said burner assembly.

2. A torch according to claim 1 wherein said gas outlet comprises a cylindrical hole formed in said valve body, wherein said burner assembly comprises a cylindrical orifice member which extends into said cylindrical hole, and wherein said resilient retaining means comprises an annular member which surrounds said cylindrical orifice member of said burner assembly.

3. A torch according to claim 2 wherein said annular member is a split ring which is provided with corrugations around the periphery thereof between the opposite ends thereof, and wherein at least one of said ends has an inwardly tapered portion adjacent thereto to facilitate axial insertion of said annular member into said cylindrical hole of said gas outlet.

4. A torch according to claim 3 wherein said sealing means comprises an annular member.

5. A torch according to claim 4 wherein said sealing means comprises a resilient annular member which surrounds said cylindrical orifice member of said burner assembly.

6. In a torch: a valve body having a gas outlet therein, said gas outlet comprising a cylindrical hole formed in said valve body; a burner assembly connected to said valve body and having passage means therein in communication with said gas outlet, said burner assembly having a cylindrical end portion which extends into said hole in said valve body; and resilient retaining means disposed between and frictionally engaging said burner assembly and portions of said valve body adjacent said gas outlet for releasably securing said burner assembly to said valve body, said resilient retaining means comprising an annular member which surrounds said cylindrical end portion of said burner assembly, said annular member comprising a split ring which is provided with corrugations around the periphery thereof between the opposite ends thereof, and wherein at least one of said ends has an inwardly tapered portion adjacent thereto to facilitate axial insertion of said annular member into said cylindrical hole of said gas outlet.

7. In a torch: a valve body having a gas outlet therein, said gas outlet comprising a cylindrical hole formed in said valve body; a burner assembly connected to said valve body and having passage means therein in communication with said gas outlet, said burner assembly having a cylindrical end portion which extends into said hole in said valve body, resilient retaining means disposed between and frictionally engaging said burner assembly and portions of said valve body adjacent said gas outlet for releasably securing said burner assembly to said valve body, said resilient retaining means comprising an annular member which surrounds said cylindrical end portion of said burner assembly, said annular member comprising a split ring which is provided with corrugations around the periphery thereof between the opposite ends thereof, and wherein at least one of said ends has an inwardly tapered portion adjacent thereto to facilitate axial insertion of said annular member into said cylindrical hole of said gas outlet; and sealing means disposed between and engaging said burner assembly and portions of said valve body adjacent said gas outlet to prevent gas from said gas outlet from flowing other than into said passage means of said burner assembly.

8. A torch according to claim 7 wherein said sealing means comprises an annular member.

9. A torch according to claim 8 wherein said sealing means comprises a resilient annular member which surrounds said cylindrical end portion of said burner assembly.

10. In a torch for use with a container of pressurized combustible gas: a valve body having a gas outlet in the form of a cylindrical hole formed in said valve body and a gas passage in said valve body in communication with said gas outlet; valve means in said valve body for controlling gas flow from said gas passage to said gas outlet; a burner assembly connected to said valve body and having passage means therein in communication with said gas outlet, said burner assembly comprising a burner tube having a tip end and a lower end, a venturi member connected to said lower end of said burner tube and a cylindrical orifice member connected to said venturi member, said cylindrical orifice member extending into said cylindrical hole in said valve body; resilient retaining means disposed between and frictionally engaging said orifice member and the side wall of said hole in said valve body for releasably securing said burner assembly to said valve body, said resilient retaining means comprising an annular member which surrounds said cylindrical orifice member of said burner assembly, said annular member comprising a split ring which is provided with corrugations around the periphery thereof between the opposite ends thereof, and wherein at least one of said ends has an inwardly tapered portion adjacent thereto to facilitate axial insertion of said annular member into said cylindrical hole of said gas outlet; and sealing means disposed between and engaging said orifice member and the side wall of said hole in said valve body to prevent gas from said gas outlet from flowing other than into said passage means in said burner assembly.

11. A torch according to claim 10 wherein said sealing means comprises an annular member.

12. A torch according to claim 11 wherein said sealing means comprises a resilient annular member which surrounds said cylindrical orifice member of said burner assembly.

* * * * *